US008316780B2

(12) United States Patent
Ng

(10) Patent No.: US 8,316,780 B2
(45) Date of Patent: Nov. 27, 2012

(54) SUPPORT DEVICE FOR MATERIALS HANDLING

(76) Inventor: Soo Seng Ng, Singapore (SG)

( * ) Notice: Subject to any disclaimer, the term of this patent is extended or adjusted under 35 U.S.C. 154(b) by 0 days.

(21) Appl. No.: 13/178,619

(22) Filed: Jul. 8, 2011

(65) Prior Publication Data

US 2012/0000400 A1 Jan. 5, 2012

Related U.S. Application Data

(60) Division of application No. 12/513,327, filed as application No. PCT/SG2007/000334 on Oct. 3, 2007, now abandoned, which is a continuation of application No. PCT/SG2006/000323, filed on Nov. 2, 2006.

(51) Int. Cl.
*B65D 19/16* (2006.01)

(52) U.S. Cl. ..... 108/56.1; 108/55.1; 108/51.3

(58) Field of Classification Search ..... 108/51.3, 108/57.19, 56.3, 56.1, 180, 157.18, 157.16, 108/157.14; 206/386, 597, 600; 220/1.5, 220/4.28, 4.31, 4.32, 6, 7; 248/346.02
See application file for complete search history.

(56) References Cited

U.S. PATENT DOCUMENTS

| | | | | | |
|---|---|---|---|---|---|
| 2,673,022 | A | * | 3/1954 | Prossen | 108/51.3 |
| 2,914,282 | A | * | 11/1959 | Budd | 108/51.3 |
| 3,026,015 | A | * | 3/1962 | Severn | 108/51.3 |
| 3,118,400 | A | * | 1/1964 | Kemp, Jr. et al. | 108/57.1 |
| 3,137,388 | A | | 6/1964 | Strouth | |
| 3,192,883 | A | * | 7/1965 | Massengale | 108/56.1 |
| 3,327,882 | A | | 6/1967 | Andrews | |
| 3,480,196 | A | * | 11/1969 | De Simas | 108/51.3 |
| 3,568,912 | A | * | 3/1971 | de Simas | 108/51.3 |
| 3,995,736 | A | * | 12/1976 | Lawson et al. | 108/51.3 |
| 4,000,704 | A | * | 1/1977 | Griffin, Jr. | 108/53.1 |
| 4,492,153 | A | | 1/1985 | Grabowski | |
| 4,561,706 | A | * | 12/1985 | Grati | 108/51.3 |
| 5,184,558 | A | | 2/1993 | Wozniacki | |
| 5,218,913 | A | * | 6/1993 | Winebarger et al. | 108/51.3 |
| 5,351,628 | A | * | 10/1994 | Breezer et al. | 108/56.1 |
| 5,417,167 | A | | 5/1995 | Sadr | |
| 5,441,154 | A | * | 8/1995 | Youell, III | 108/51.3 |
| 5,568,774 | A | * | 10/1996 | Hutchison | 108/51.3 |
| 5,597,084 | A | * | 1/1997 | Parasin | 220/4.28 |
| 5,704,508 | A | | 1/1998 | Keip et al. | |

(Continued)

FOREIGN PATENT DOCUMENTS

EP 0 675 048 A1 10/1995

(Continued)

OTHER PUBLICATIONS

Written Opinion and International Search Report for corresponding International Application No. PCT/SG/2007/000334, issued Jan. 28, 2008.

*Primary Examiner* — Jose V Chen
(74) *Attorney, Agent, or Firm* — Heslin Rothenberg Farley & Mesiti P.C.; Victor A. Cardona, Esq.

(57) ABSTRACT

A support device for materials handling includes a plurality of leg members used to form a support structure. A deck member is mounted on the support structure to form the support device. In particular, the deck member comprises a plurality of recesses on a first side shaped to receive the plurality of leg members.

19 Claims, 24 Drawing Sheets

U.S. PATENT DOCUMENTS

| | | | | |
|---|---|---|---|---|
| 5,794,542 | A * | 8/1998 | Besaw | 108/51.3 |
| 5,934,202 | A * | 8/1999 | Lai | 108/51.3 |
| 6,041,718 | A * | 3/2000 | Brandes et al. | 108/51.3 |
| 6,155,181 | A * | 12/2000 | Chilcutt | 108/51.3 |
| 6,581,769 | B2 * | 6/2003 | Nist | 206/386 |
| 6,832,562 | B2 * | 12/2004 | Tabor et al. | 108/55.1 |
| 6,966,449 | B2 * | 11/2005 | Williams | 220/4.31 |
| 7,000,549 | B2 * | 2/2006 | Nelson | 108/51.3 |
| 7,475,639 | B2 * | 1/2009 | Chen | 108/51.3 |
| 7,681,735 | B2 * | 3/2010 | Youell, Jr. | 108/51.3 |
| 7,761,963 | B2 * | 7/2010 | Koch et al. | 220/4.28 |
| 2004/0129699 | A1 | 7/2004 | Williams | |
| 2006/0016373 | A1 * | 1/2006 | Gordon | 108/51.3 |
| 2008/0047473 | A1 * | 2/2008 | Ferguson | 108/56.1 |
| 2008/0295747 | A1 * | 12/2008 | Vinderola | 108/51.3 |

FOREIGN PATENT DOCUMENTS

| | | |
|---|---|---|
| JP | 6-171649 | 6/1994 |
| JP | 6-191535 | 7/1994 |
| JP | 2004-10053 | 1/2004 |
| WO | WO 94/20377 | 9/1994 |
| WO | W02006/056104 A1 | 6/2006 |

* cited by examiner

SUPPORT DEVICE FOR MATERIALS HANDLING

CROSS-REFERENCE TO RELATED APPLICATIONS

This application is a Divisional of U.S. Ser. No. 12/513,327 filed on May 1, 2009, which was a 371 national stage of PCT International Application No. PCT/SG2007/000334, filed on Oct. 3, 2007, and published in English on May 8, 2008 as WO 2008/054328, which is a Continuation of PCT-international (PCT) application No. PCT/SG2006/000323 filed on 2 Nov. 2006, and published in English on May 8, 2008 as WO 2008/054325, the entire disclosures of which are hereby incorporated by reference.

FIELD OF THE INVENTION

The present invention relates to materials handling, including the transportation and storage of materials, goods and freight. In particular, the invention relates to devices used to facilitate said transportation and storage through support of said materials, goods and freight.

BACKGROUND OF THE INVENTION

Support devices such as pallets provide a portable platform for storing or moving goods that are placed on it and are used in a wide variety of fields including, for example, agriculture, food, pharmaceuticals, chemicals, electrical goods and automotives. Desirable qualities for such support devices include strength, stiffness, durability, compatible functionality and relatively low cost. Strength relates to the load carrying capacity of a support device; support devices must be sufficiently strong to support the required load. Stiffness is the resistance of a support device to deformation under a load. Durability is the ability of a support device to withstand the rigors of the transportation and handling environment. Functionality relates to the compatibility of a support device with particular goods and material handling equipment. Although the desirable qualities of support devices are known, it is difficult to design a support device having all these desirable qualities as these qualities are interactive and optimising just one, for example, minimising price, often impacts the others adversely. For example, support devices made of paper are known. These are lightweight, easily recyclable, dry, bug free, and have a smooth deck surface. However, support devices made of paper are susceptible to moisture, lack stiffness and durability, and offer low product protection. Additionally, while paper per se is relatively inexpensive, paper based support devices are not. In view of the foregoing, it would be desirable to have a support device that achieves a good balance of the desirable qualities.

SUMMARY OF THE INVENTION

In a first aspect the invention provides a support device having:

a plurality of leg members; and a deck member mounted on the plurality of leg members;

wherein the deck member comprises a plurality of recesses on a first side shaped to receive the plurality of leg members.

In a second aspect the invention provides the support device of any one of the preceding claims, wherein the support device is substantially made of any one or a combination of oriented strand board (OSB), high density polyethylene (HDPE), sawn timber, particle board and recycled plastic.

It will be appreciated that an advantage of the invention is the ease and speed of construction of such a device. For instance, a feature of the present invention includes the leg members fitting within the plurality of recesses of the deck member allows immediate location of the leg members in the preferred orientation. In a preferred embodiment, the recesses may be such that on fitting the leg members to the deck member, the support device is in a final orientation without a need for glue, nails or other fastening means. Accordingly the mechanical engagement of the leg members to the recesses may provide sufficient strength for the support device to be used immediately.

In a further preferred embodiment, the deck member may further include recesses on a second surface. In this case, the second surface may be used to stack other support devices. In so doing, the stacked support devices may allow for their respective leg members to fit within said recesses, creating a mechanical engagement, and so add to the stability of the stack.

Alternatively, the plurality of recesses on the second surface may permit the engagement of wall members, which may in turn form a case assembled on the support device. Thus, as with the recesses of the first surface, engagement of the wall members to the deck member may be achieved through mechanical engagement alone without the need for glue, nails, staples etc.

BRIEF DESCRIPTION OF THE DRAWINGS

It will be convenient to further describe the present invention with respect to the accompanying drawings that illustrate possible arrangements of the invention. Other arrangements of the invention are possible, and consequently the particularity of the accompanying drawings is not to be understood as superseding the generality of the preceding description of the invention.

FIG. 11A illustrates a fully assembled support device having the support structure of the second variation as illustrated in FIG. 3, while

FIG. 12A illustrates a fully assembled support device having the support structure of the third variation as illustrated in FIG. 4, while

FIG. 13A illustrates a fully assembled support device having the support structure of the fourth variation as illustrated in FIG. 5, while

FIG. 14A illustrates the fully assembled support device of FIG. 11A, but having a skid member of a different configuration, while

FIG. 15A illustrates the fully assembled support device of FIG. 11A, but having a skid member of yet another configuration, while

FIG. 20A illustrates an assembled view of a case having a lid, while

FIG. 22A illustrates a case having a lid member of another configuration, while

FIG. 23A illustrates a case having a lid member of yet another configuration, while

DETAILED DESCRIPTION OF THE EMBODIMENTS

Figure 1:
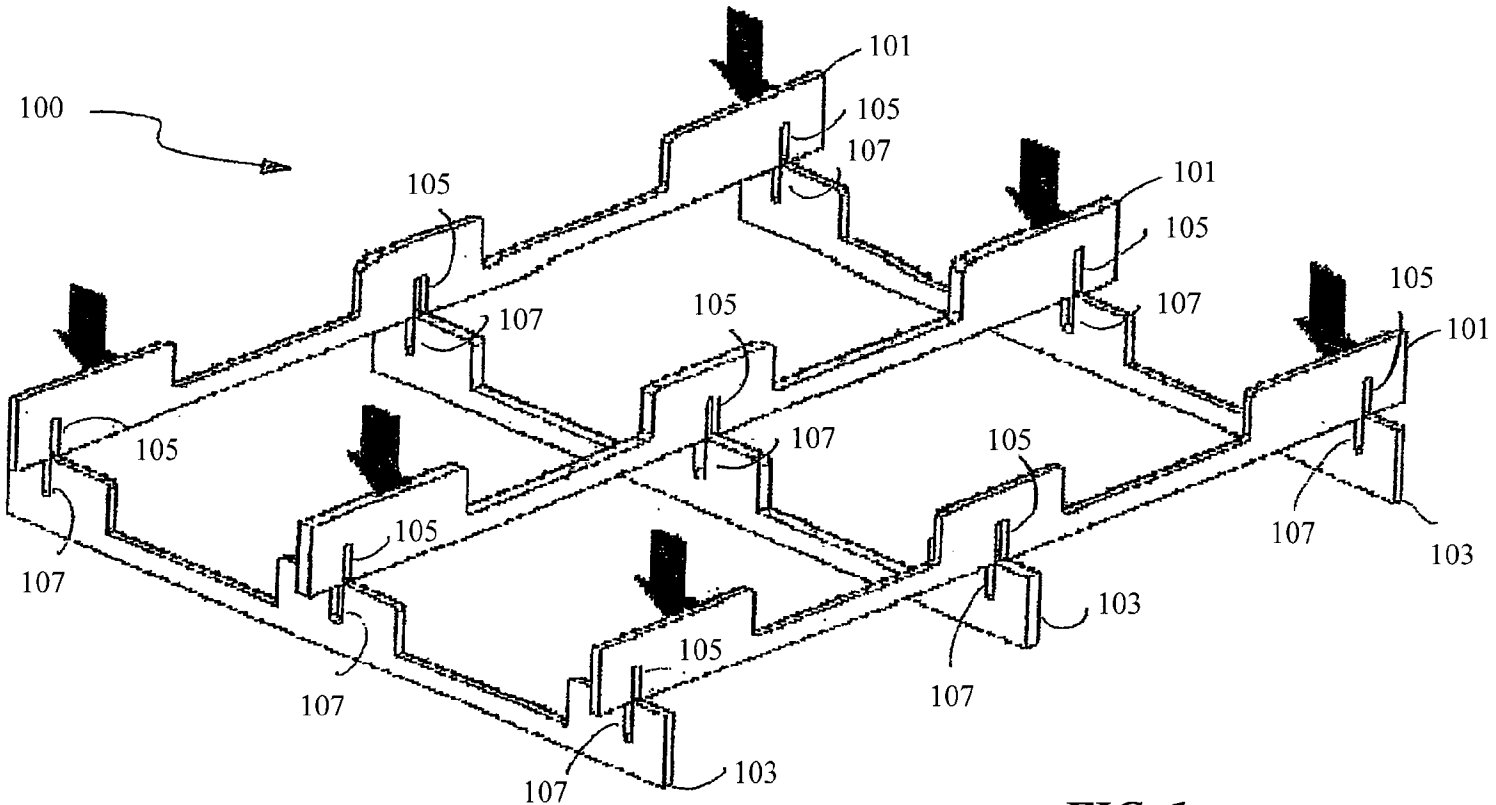
FIG. 1 illustrates respective planar units engaging to form a plurality of leg members of a support structure of a first variation.

The detailed description set forth below in connection with the appended drawings is intended as a description of embodiments of the support device, and is not intended to represent the only form in which the present invention may be practiced. It is to be understood that the same or equivalent functions may be accomplished by different embodiments that are intended to be encompassed within the scope of the invention. In the drawings, like numerals are used to indicate like elements throughout.

The embodiments of the present invention as will be described include the following components:

(i) a support structure; and (ii) a deck member

However, these various embodiments may further include one or more of the following components:

(iii) a skirting member;

(iv) a bridge assembly;

(v) a skid member; and (vi) a lid member

1. Support Structure

A first variation of a support structure 100 is illustrated in FIG. 1, which shows a first set of planar units 101 and a second set of planar units 103. The first set of planar units 101 comprises a plurality of slots 105 and, likewise, the second set of planar units 103 also comprises a plurality of slots 107. FIG. 1 illustrates the slots 105 engaging with the corresponding slots 107, while FIG. 2 illustrates the slots 105, 107 being engaged to form a plurality of leg members of the support structure 100 of a first variation.

Figure 2:
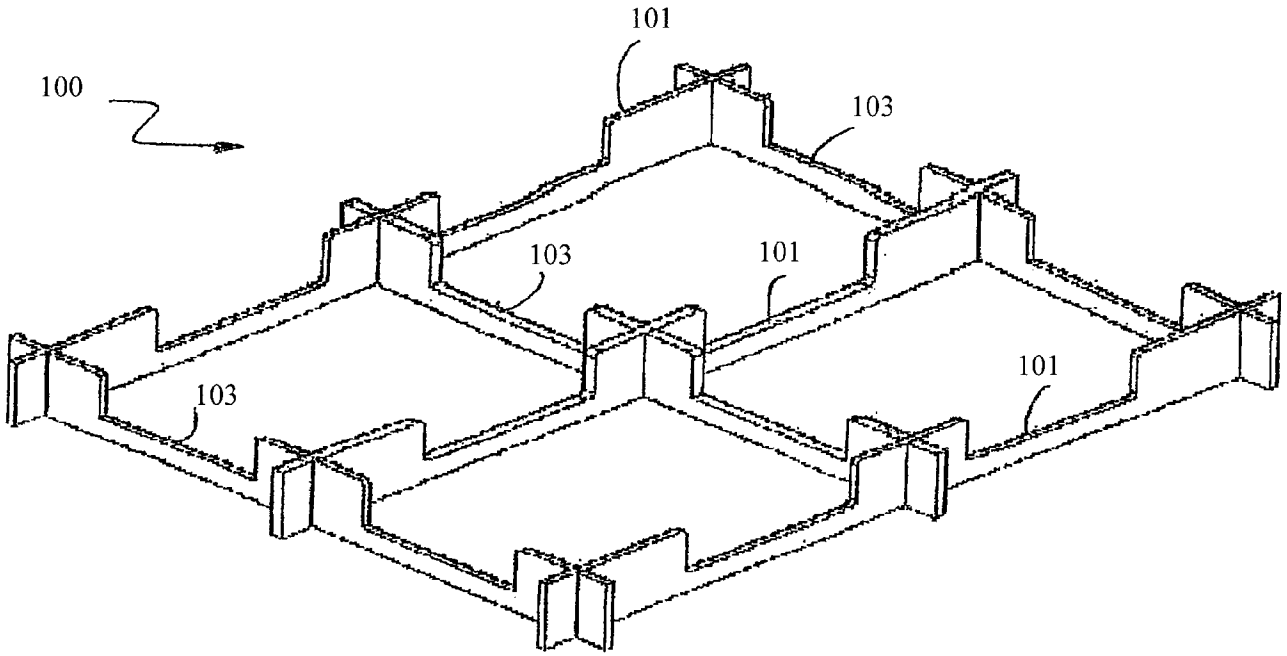
FIG. 2 illustrates the respective planar units of FIG. 1 being engaged to form the plurality of leg members.
Figure 3:
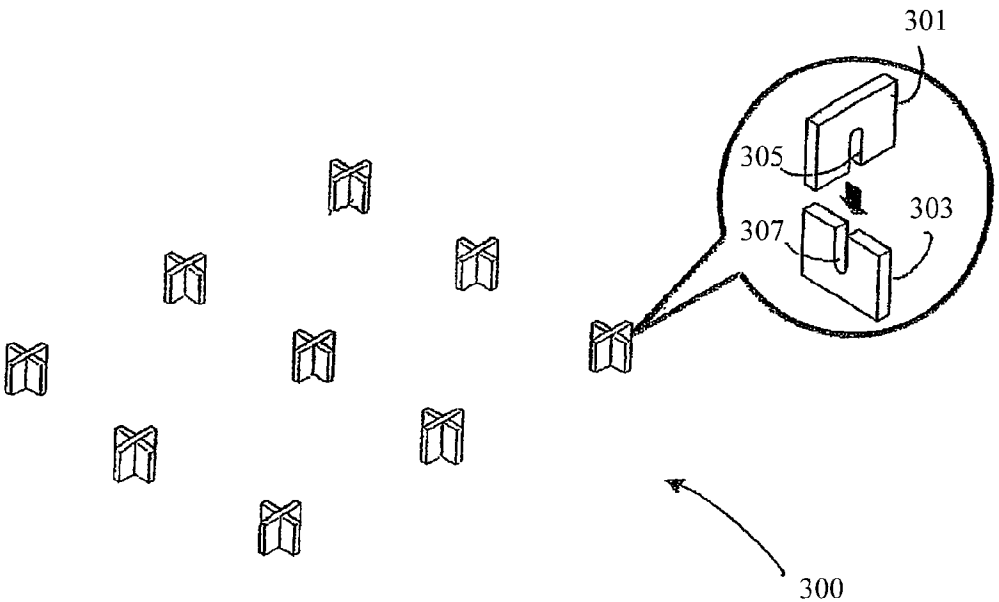
FIG. 3 illustrates respective planar units being engaged to form a support structure of a second variation.

A second variation of the support structure 300 is illustrated in FIG. 3, in which each leg member of the support structure 300 is made up of two planar units 301, 303. Like the planar units 101, 103 shown in FIGS. 1 and 2, respective planar units 301, 303 comprise corresponding slots 305, 307 which engage to form leg members of the support structure 300 of the second variation.

Figure 4:
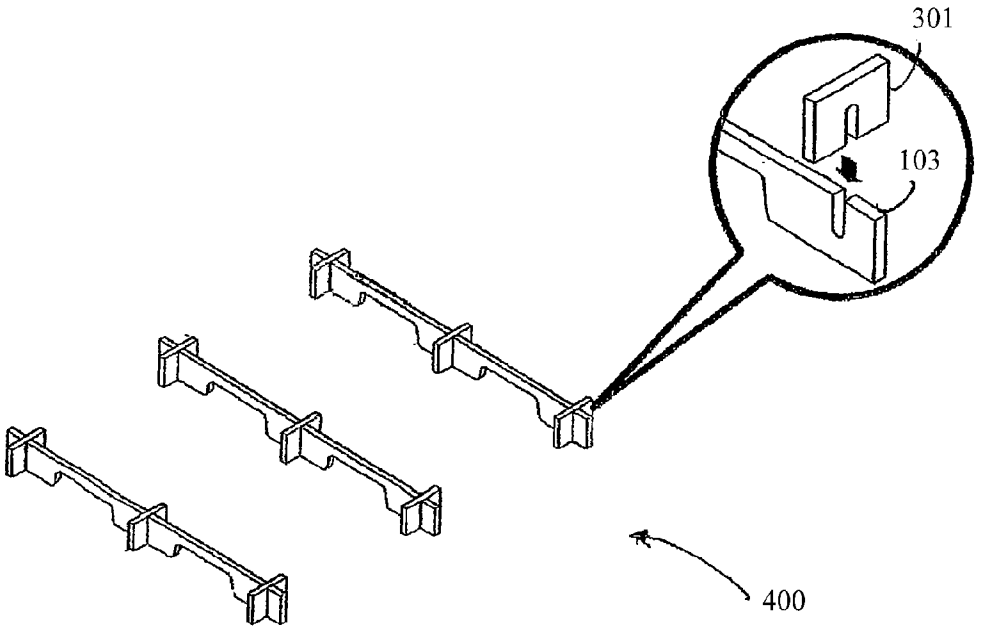
FIG. 4 illustrates respective planar units being engaged to form a support structure of a third variation.

A third variation of the support structure 400 is illustrated in FIG. 4, in which each leg member of the support structure 400 is made up of the planar units 103 illustrated in FIGS. 1 and 2 the planar units 301 illustrated in FIG. 3.

Figure 5:
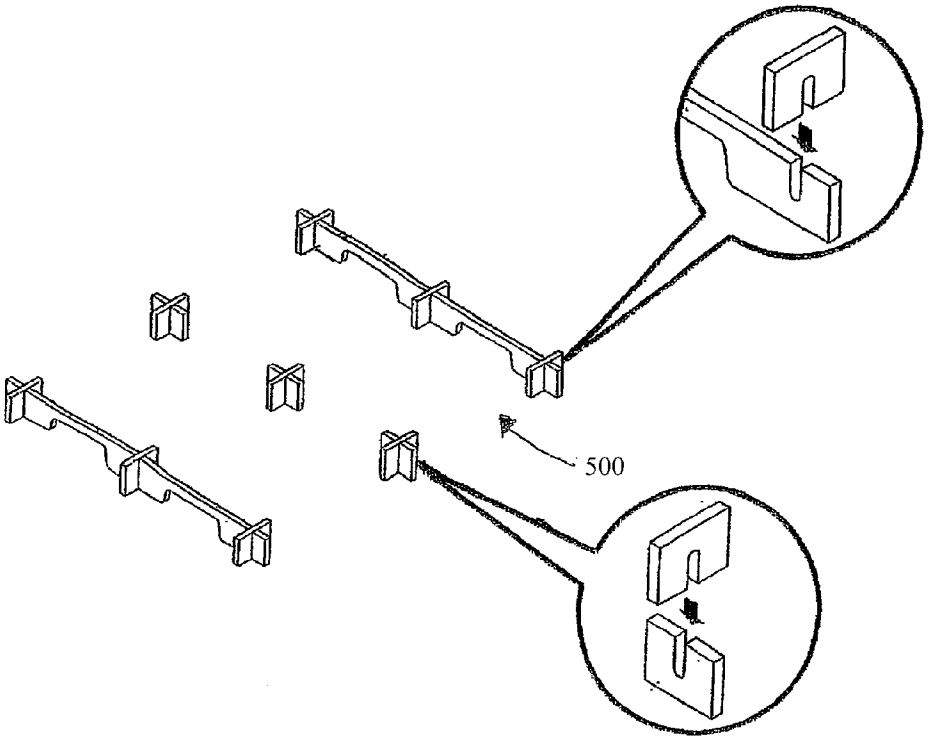
FIG. 5 illustrates respective planar units being engaged to form a support structure of a fourth variation.

A fourth variation of the support structure 500 is illustrated in FIG. 5, in which the plurality of leg members of the support structure 500 is made up of a mixture of leg members of the support structures 100, 300 of the first and second variations.

2. Deck Member (Bottom Surface)

Figure 6:
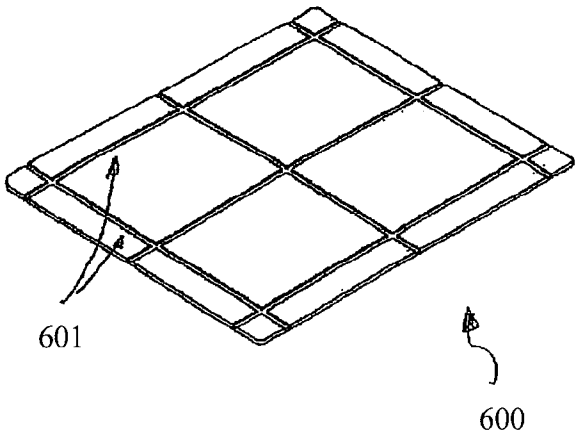
FIG. 6 illustrates a bottom view of a deck member of a first variation.

A bottom surface of a deck member 600 of a support device is illustrated in FIG. 6. In particular, the deck member 600 has a patterned underside in the form of a plurality of recesses 601. Respective ones of the planar units 105, 107, 301, 303 of the support structure 100, 300, 400, 500 can accordingly engage with these recesses 601 which have been shaped so that the support structures 100, 300, 400, 500 can engage with the deck member 600.

In addition, the deck member 600 also comprises recesses on a top surface (not shown in FIG. 6) either for stacking another support device or for receiving a plurality of wall members to define a storage space. The top surface of the deck member 600 will be described later. In particular, the patterned recesses on the top surface for stacking another support device may mirror the patterned recess on the underside for engaging with any one of the support structure 100, 300, 400, 500.

Figure 7:
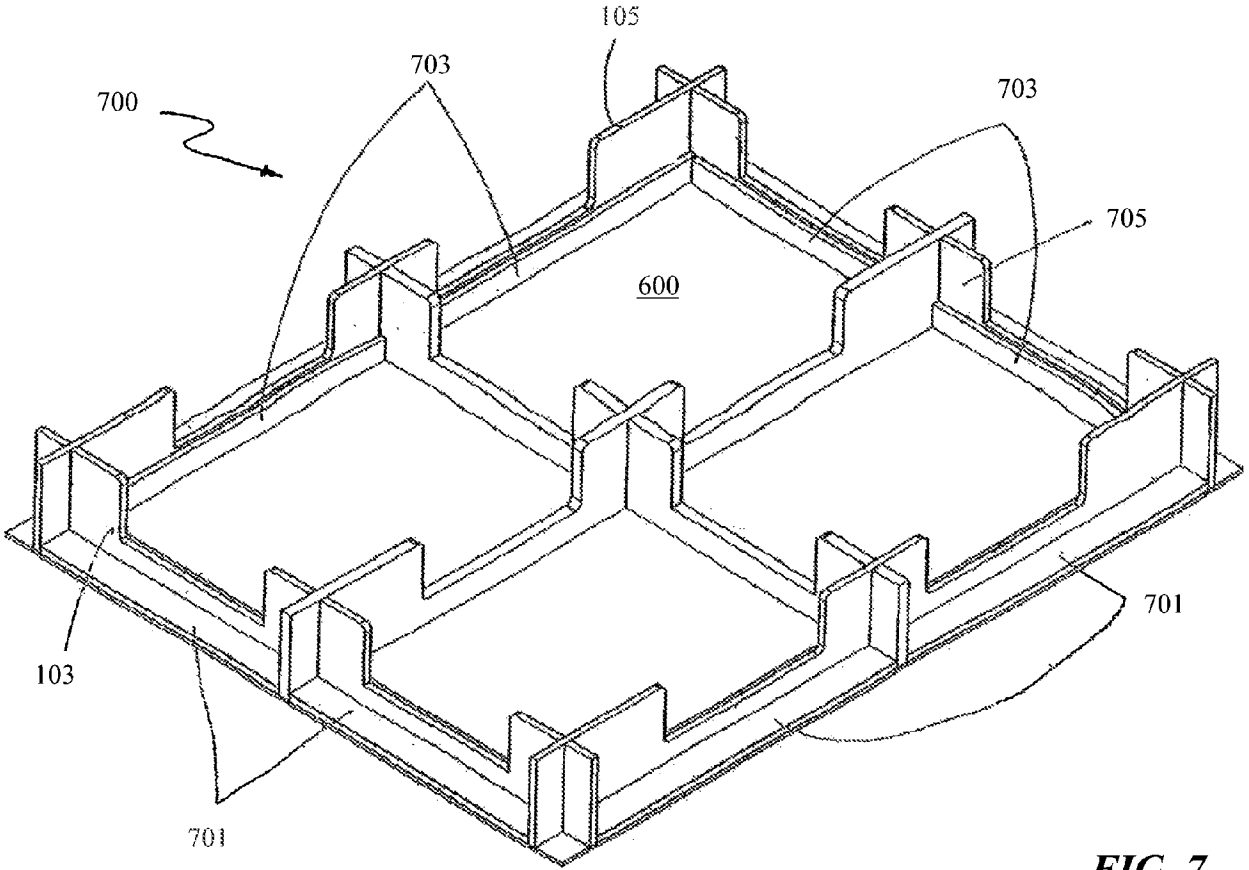
FIG. 7 illustrates a bottom view of a support device having the support structure of FIGS. 1 and 2 and having a plurality of skirting members.

FIG. 7 illustrates the deck member 600 of FIG. 6 being engaged with the support structure 100 of the first variation to form a support device 700.

3. Skirting Member

The support device 700 illustrated in FIG. 7 further comprises a plurality of first and second skirting members 701 and 703 being attached to the support device 700. The first skirting members 701 are disposed against the bottom surface of the deck member 600 along portions of the periphery of the support device 700 defined by the support structure 100, while the second skirting members 703 are disposed against adjacent leg members of the support structure 100.

The first skirting members 701 enhance the impact strength of the support device 700 around its periphery, increasing its ability to withstand daily rough handling and abuse and thus extending the service life of the support device 700. The second skirting members 703 enhance the structural strength of the support structure 700 defined by the support structure 100.

In particular, the second skirting members 703 serve to enhance the lateral impact strength of the support device 700, as well as spread the weight of the support device through the leg members. Accordingly, this may limit localized damage to the leg members and the surface upon which the support device has been placed. Further they may increase its resistance to compression and bending, thereby improving the performance of the support device 700.

Advantageously, the first and second skirting members 701 and 703 strengthen the support device 700 without adding significant weight to it or increasing manufacturing cost substantially.

Figure 8:
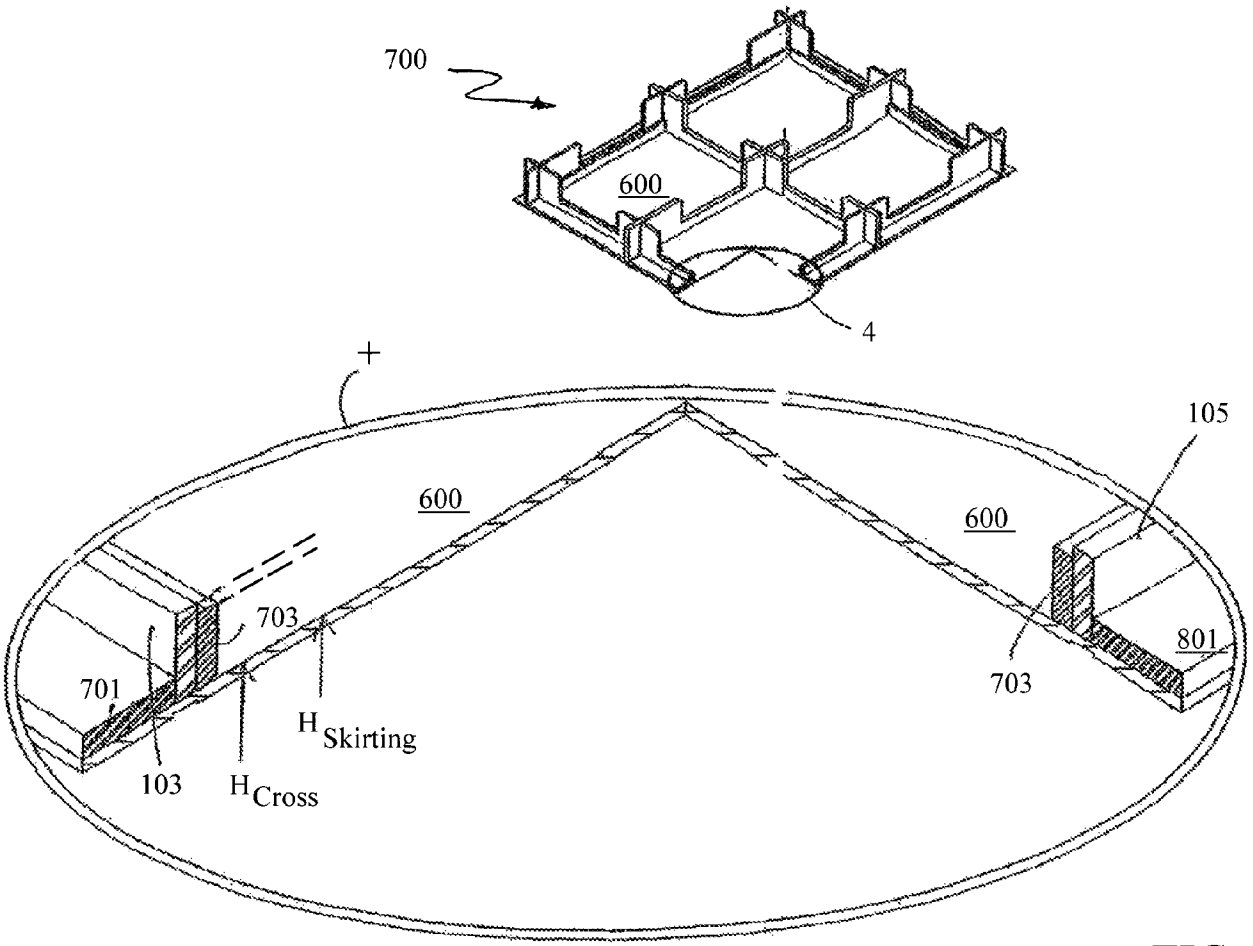
FIG. 8 illustrates an enlarged cross-sectional view of the support device of FIG. 7.

FIG. 8 illustrates an enlarged cross-sectional view of a cut-away portion X of the support device 700 of FIG. 7. As can be seen from FIG. 8, each of the second skirting members 703 is of a height $H_{skirting}$ less than a height $H_{cross}$ of the corresponding planar units 101, 103 of the support structure 100 against which the second skirting members 703 are disposed. This is so as to facilitate the mounting of a bridge assembly on the underside of the deck member 600 as will be explained as follows.

4. Bridge Assembly

Figure 9:
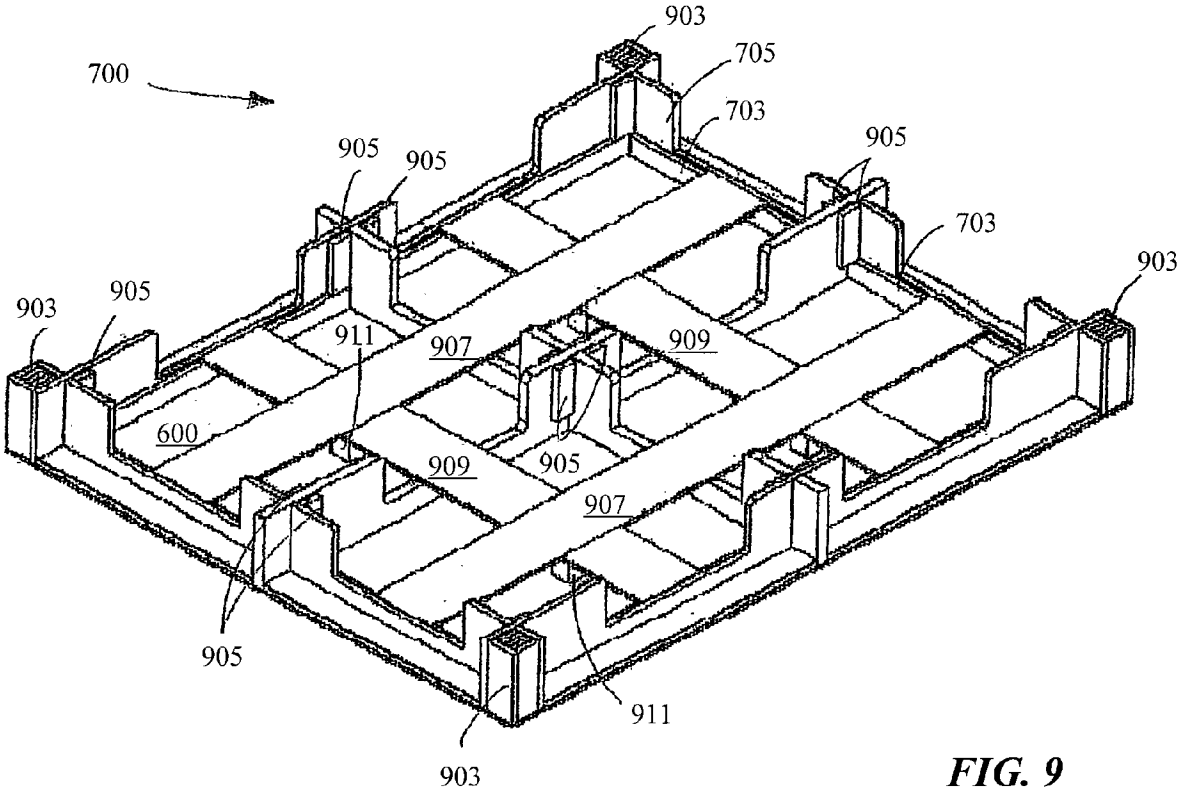
FIG. 9 illustrates the support device of FIG. 7 further having a bridge assembly, a plurality of reinforcing elements and a plurality of stiffening elements of the embodiment.

FIG. 9 illustrates the bridge assembly, a plurality of reinforcing elements 903 and a plurality of stiffening elements 905 being attached to the support device 700. The bridge assembly is mounted to the bottom surface of the deck member 600. The reinforcing elements 903 are disposed at respective corners of the support device 700, while the stiffening elements 905 are disposed against the leg members of the support structure 100.

The bridge assembly includes first and second sets of deck boards 907 and 909. As shown in FIG. 9, the deck boards in each of the first and second sets 907 and 909 are in a spaced apart relationship, and the first set of deck boards 907 is substantially orthogonal to the second set of deck boards 909. The first and second sets of deck boards 907 and 909 are mounted in a spaced apart relationship from the bottom surface of the deck member 600 via a plurality of bridge support members 911 serving as connectors and standoffs.

In this embodiment, ends of the deck boards in the first and second sets 907 and 909 are supported on the second skirting members 703 and abut the inner peripheral surface 705 of the support structure 100. The bridge assembly may be mounted to the bottom surface of the deck member 600 by industrial staples, nails, screws, timber glue or a combination of said fastening methods. The bridge assembly protects an underside of the support device 700 because any material handling equipment accessing the support device 700 first makes contact with the bridge assembly and is guided by its surface such that it slides under the support device 700 without creating impact marks on the underside of the support device 700. In a similar manner, the bridge assembly also protects the underside of the support device 700 from damage when the material handling equipment leaves the support device 700.

The reinforcing elements 903 are sized and shaped to fit and fill out the respective corners of the support device 700 defined by the support structure 100 and the deck member 64. The reinforcing elements 903 may be attached to the corners of the support device 700 by industrial staples, nails, screws, timber glue or a combination of said fastening methods. The reinforcing elements 903 fortify the corners of the support device 700 and serve to increase the corner impact strength of the support device 700.

The support device 700 shown in FIG. 9 may be used in light- and medium-duty applications for design loads of up to about 1 metric ton.

5. Skid Members

Figure 10:
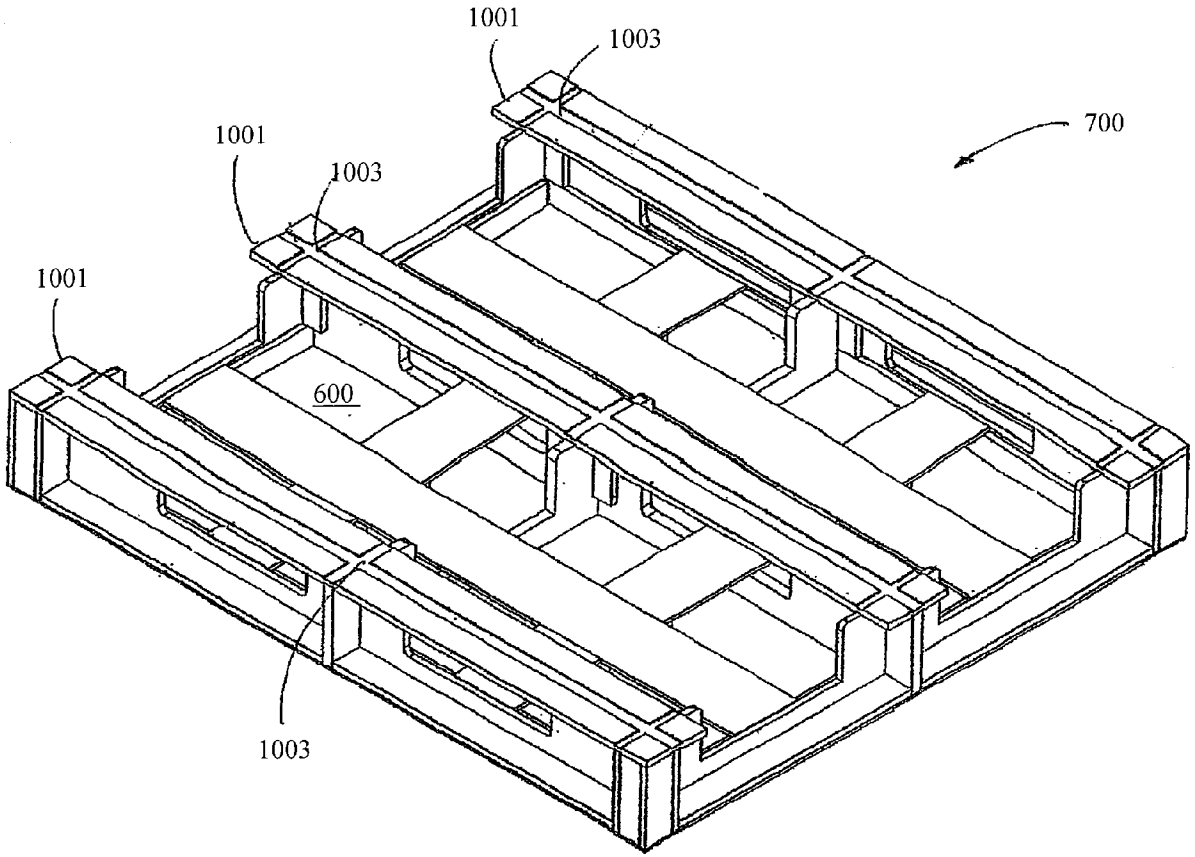
FIG. 10 illustrates the support device of FIG. 9 further having a plurality of skid members.

FIG. 10 illustrates a plurality of skid members 1001 being attached to the support device 700. The skid members 1001 are attached to the support structure 100 via a plurality of recesses (not shown) on the corresponding surface of the skid members 1001. In particular, these recesses are shaped for the attachment between the skid members 1001 and the support structure 100. As shown in FIG. 10, a plurality of recesses 1003 is also formed on a bottom surface of the skid members 1001 which may mirror the recesses on the top surface. In circumstances where the support device 700 is placed on an uneven surface, or a surface of inconsistent firmness, the skid members 1001 may act to increase the bearing surface of the support device 700. This has several advantages, including protecting the support structure 100 from localized damage and providing additional stability to the support device 700.

The recess 1003 layout on the bottom surface of the skid member 1001 provides traceability to the location of respective leg members of the support structure 100 to facilitate positioning of fasteners (not shown), assist in concealing the fasteners on the bottom surface and protect the fasteners from external damage particularly due to wear and tear.

The skid members 1001 may be attached to the base of the support structure 100 by industrial staples, nails, screws, timber glue or a combination of said fastening methods.

Figure 11A:
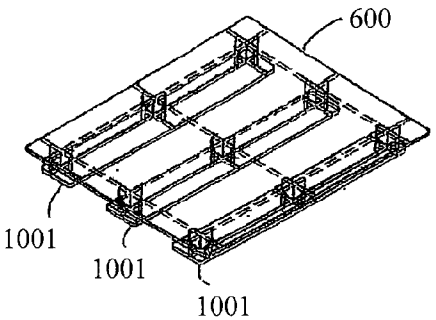
Figure 11B:
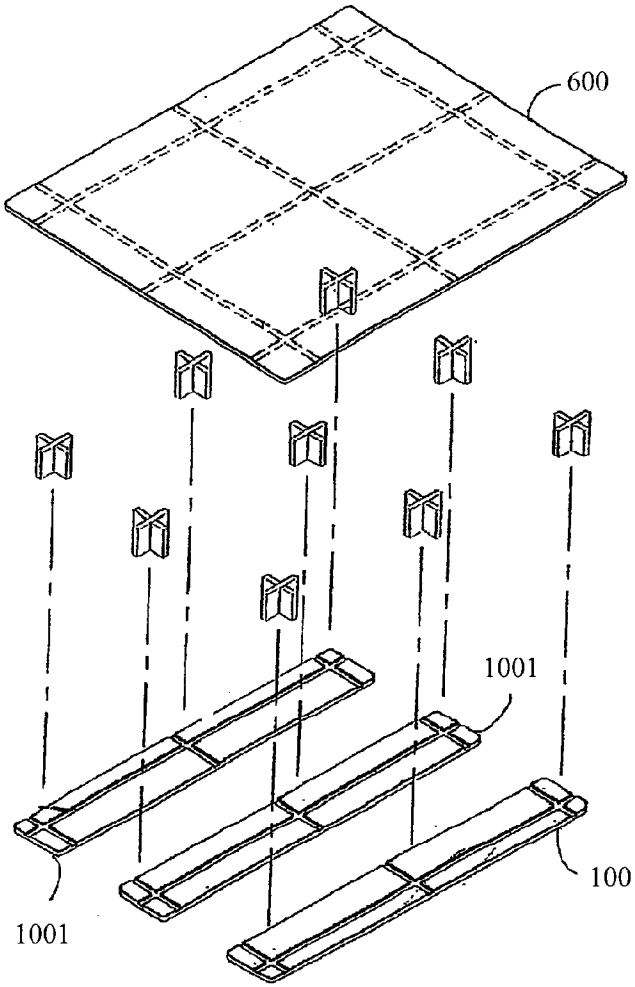
FIG. 11B illustrates an exploded view of the support device of FIG. 11A.
Figure 12A:
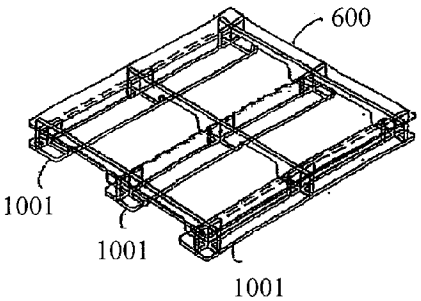
Figure 12B:
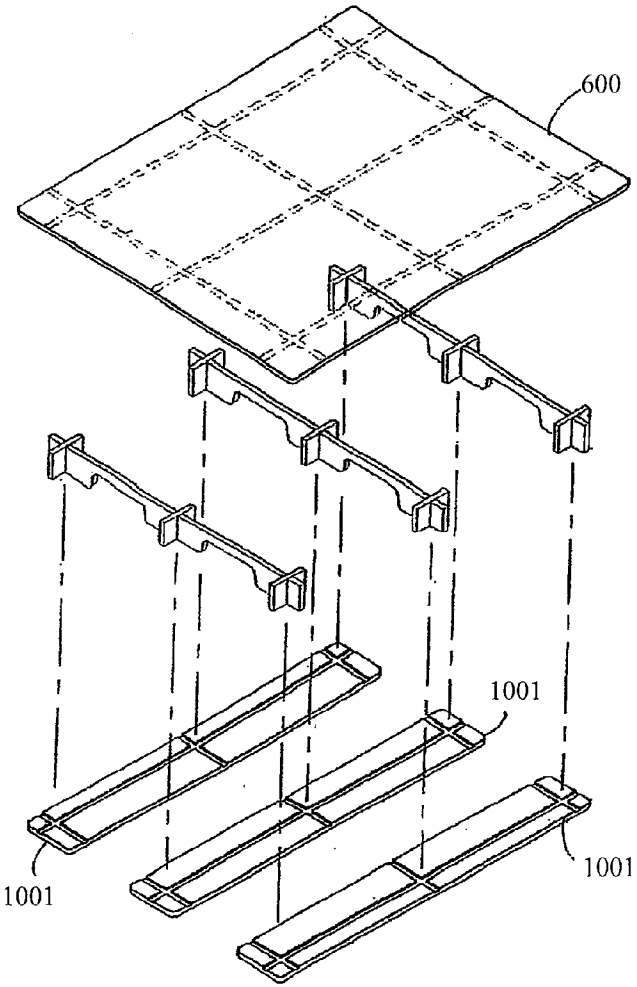
FIG. 12B illustrates an exploded view of the support device of FIG. 12A.
Figure 13A:
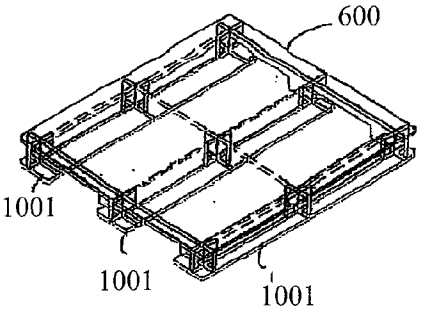
Figure 13B:
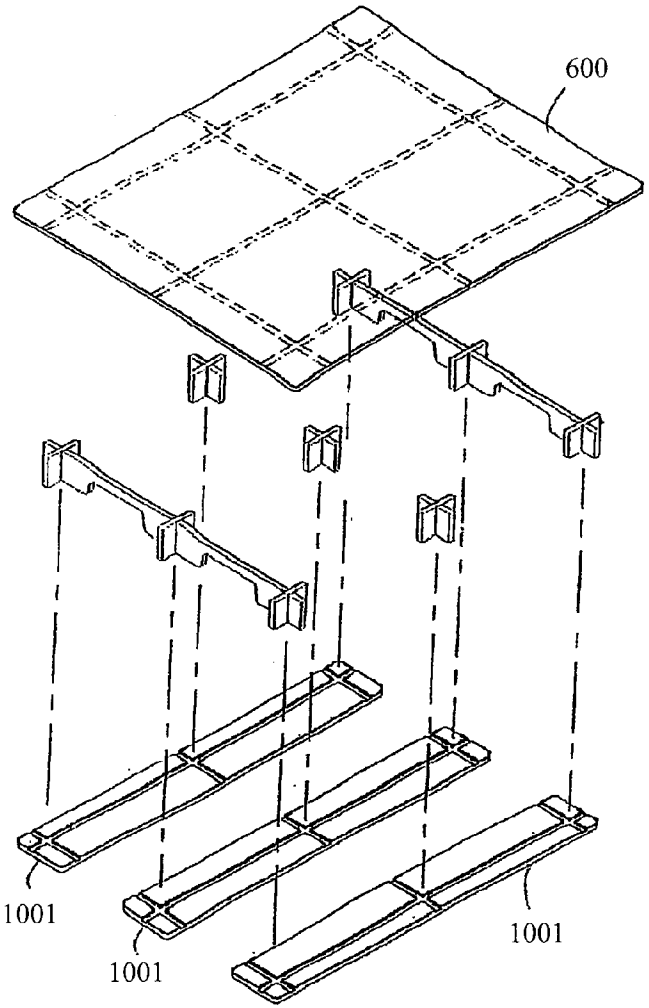
FIG. 13B illustrates an exploded view of the support device of FIG. 13A.
Figure 14A:
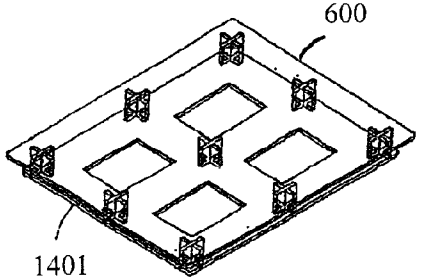
Figure 14B:
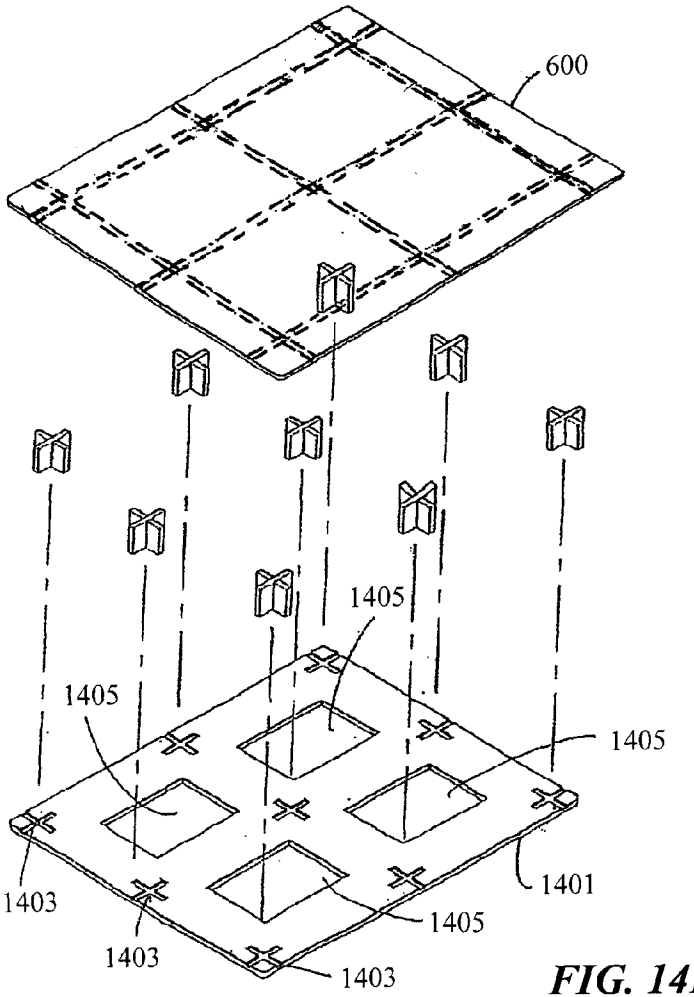
FIG. 14B illustrates an exploded view of the support device of FIG. 14A.
Figure 15A:
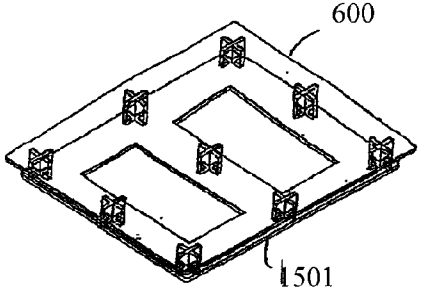
Figure 15B:
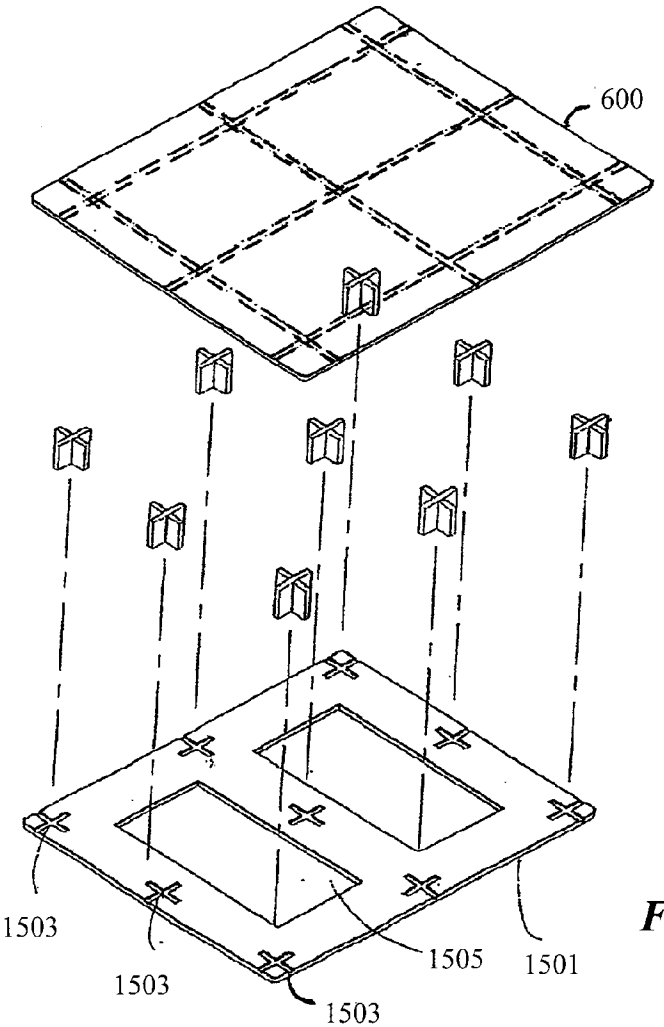
FIG. 15B illustrates an exploded view of the support device of FIG. 15A.

FIGS. 11 to 15 illustrate the fully assembled views of the support device. It is shown that the skid members 1001 which engage with the support structures 300, 400, 500 as illustrated in FIGS. 11 to 13 are identical to the skid members 1001 used for the support structure 100 as illustrated in FIG. 10. However, each of FIGS. 14 and 15 illustrates a single skid member 1401, 1501 having a plurality of recesses 1403, 1503 shaped to engage with the support structure 300 as illustrated in FIG. 3.

Further, whereas the skid member 1401 illustrated in FIG. 14 comprises four cavities, the skid member 1501 illustrated in FIG. 15 comprises two cavities. The number of cavities in the skid member 1401, 1501 may be varied according to the amount of friction desired to ensure the stability of the support device. That is, the greater the number of cavities in the skid member 1401, 1501, the greater the stability of the support device will be.

6. Deck Member (Top Surface)

Figure 16:
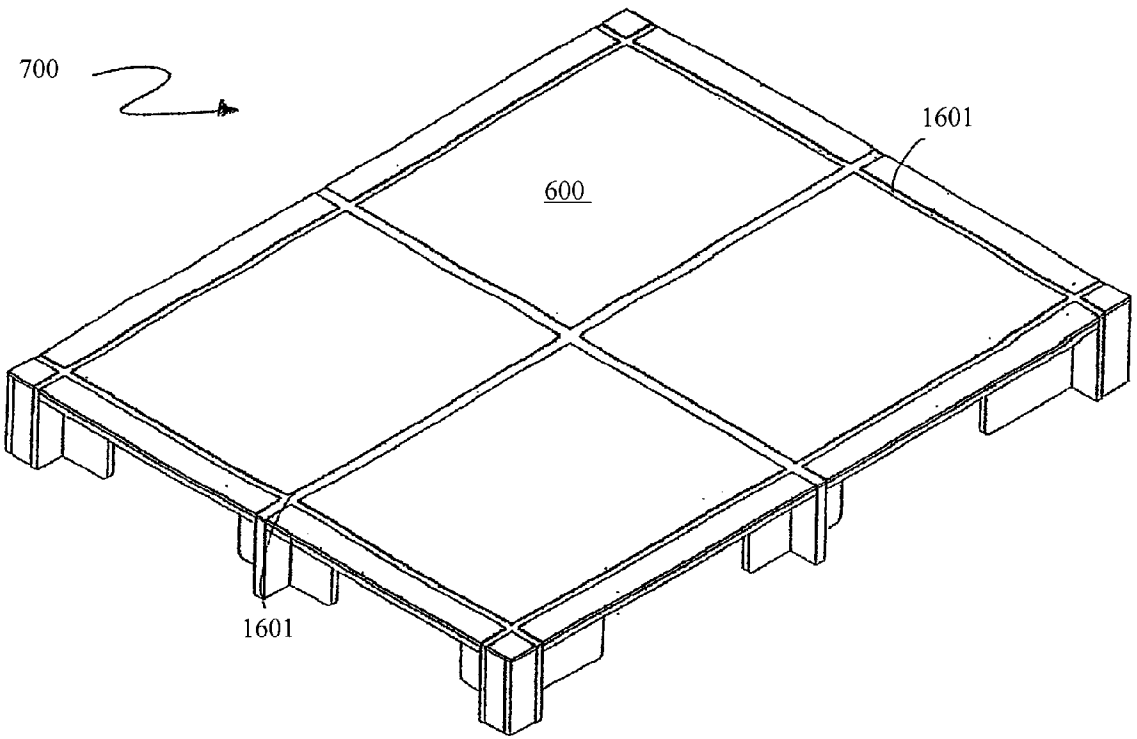
FIG. 16 illustrates the support device of FIG. 9 in an upright position.

Referring now to FIG. 16, a top surface of the deck member 600 of FIG. 6 is now shown, which includes a plurality of recesses 1601 shaped to receive a second support device (not shown) for stacking. Specifically, these recesses 1601 are shallow recesses machined at specific locations on the top surface of the deck member 600 to coincide with the footprint of the second support device so as to receive the support structure of the second support device. In this way, the recesses 1601 facilitate stacking of the support devices and thus the transfer of support devices. In particular, the recesses 1601 on the top surface may mirror the recesses 601 on the bottom surface which have been illustrated in FIG. 6. In addition, the recesses 1601 also assist in concealing the fasteners (not shown) on the top surface of the deck member 600. Apart from aesthetic benefits, this also protects the fasteners from external damage.

Figure 17:
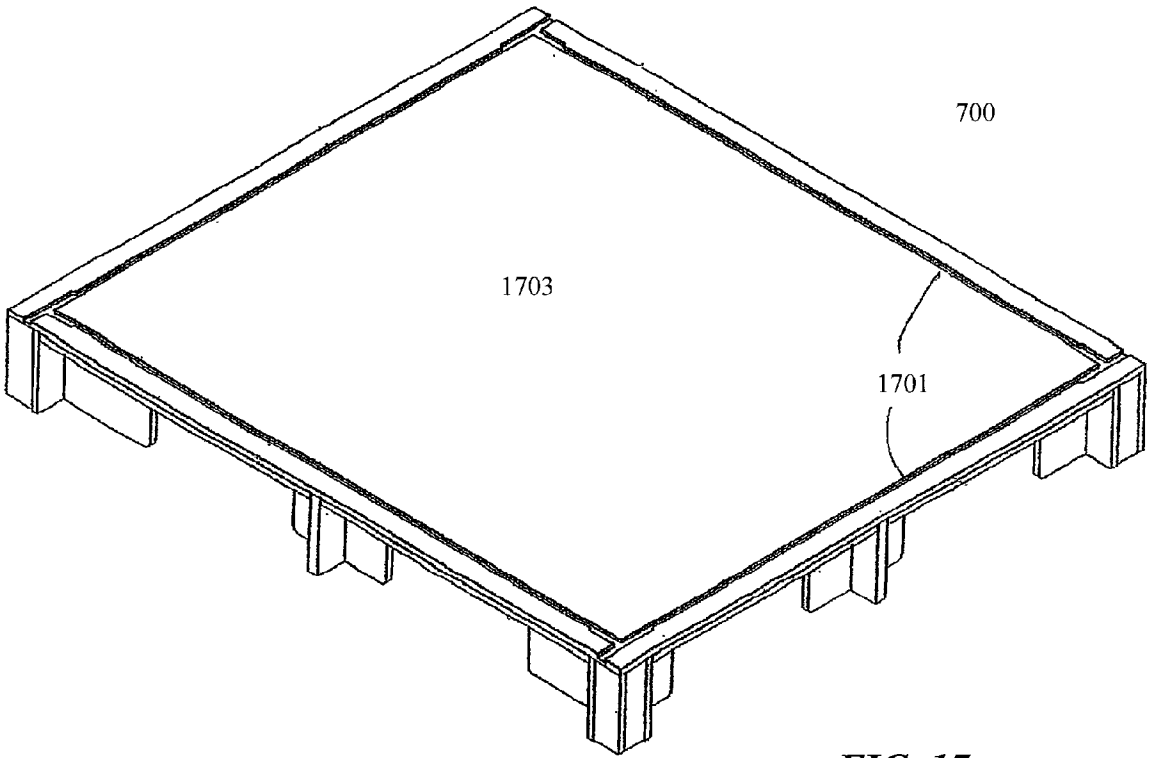
FIG. 17 illustrates the support device of FIG. 16, but having a deck member of a second variation.

Referring to FIG. 17, a deck member 1703 having a top surface of another variation is shown. In this particular embodiment, the top surface of the deck member 1703 includes a plurality of recesses 1701 arranged and shaped to receive respective ones of a plurality of interlocking wall members (not shown) to define a case having a storage space.

Figure 18:
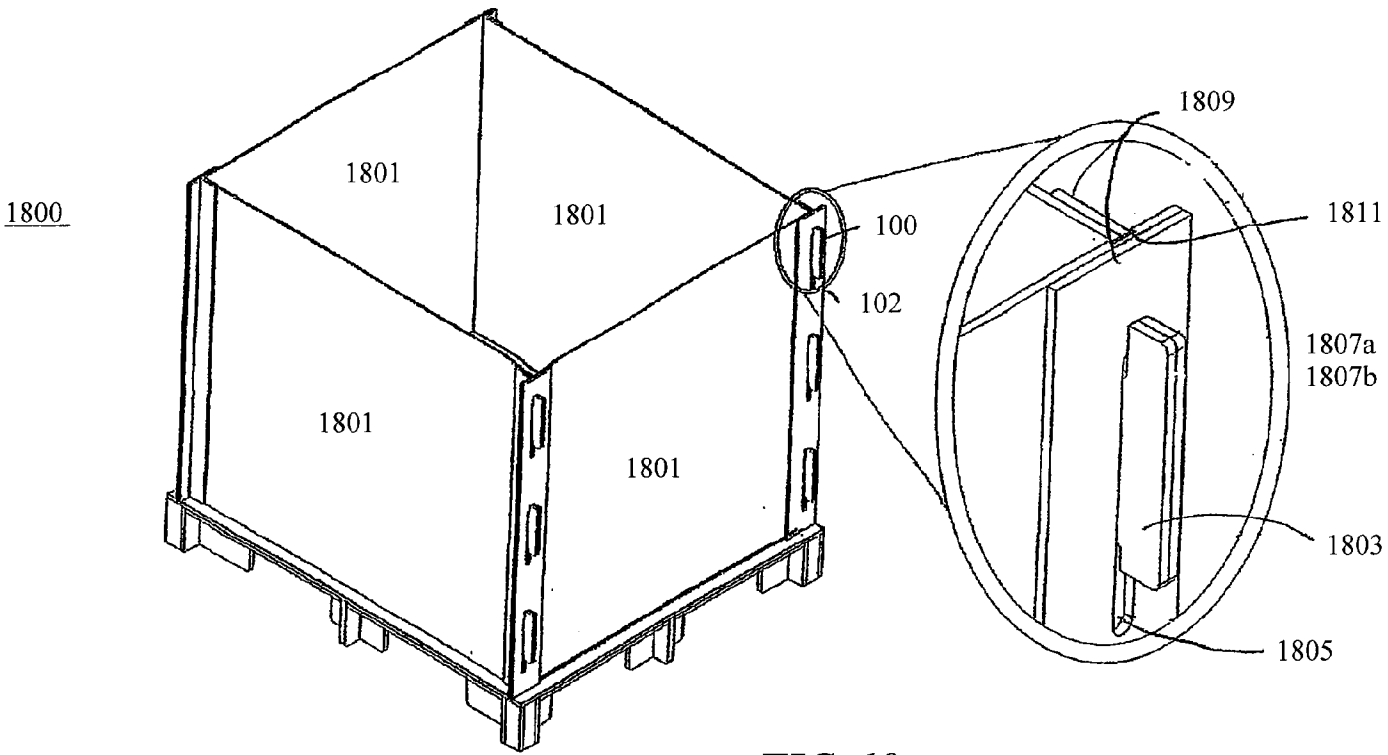
FIG. 18 illustrates a case having the support device of FIG. 17 and further having a plurality of inter-engageable wall members.

Referring now to FIG. 18, a case 1800 comprising a plurality of interlocking wall members 1801 received in respective ones of the recesses 1701 on the top surface of the deck member 1703 is shown. Respective wall members 1801 interlock with one another via an ear 1803 and slot 1805 arrangement. Advantageously, the interlocking wall members 1801 do not require fasteners for assembly. Said ear 1803 includes lugs directed upwards and downwards so as to prevent accidental disengagement of the wall members 1801. Further the ear 1803 has been reinforced with double thickness sheets 1807A, 1807B to strengthen the engagement. Similarly, the edges of said wall members 1801 are selectively reinforced with stiffening members 1809 fixed to said edges.

A feature of the engagement of the wall members 1801 is the engagement between the edges of the wall members 1801, whereby the edge of a particular wall member 1801 fits into a full length recess 1811 in the corresponding wall member 1801. This has the dual effect of ensuring a reliable fit, as well as in practice, preventing the ingress of water dirt and insects. Thus, the provision of the edge of a wall member 1801 to recess 1811 fixture assists in the sealing of the case 1800.

Figure 19:
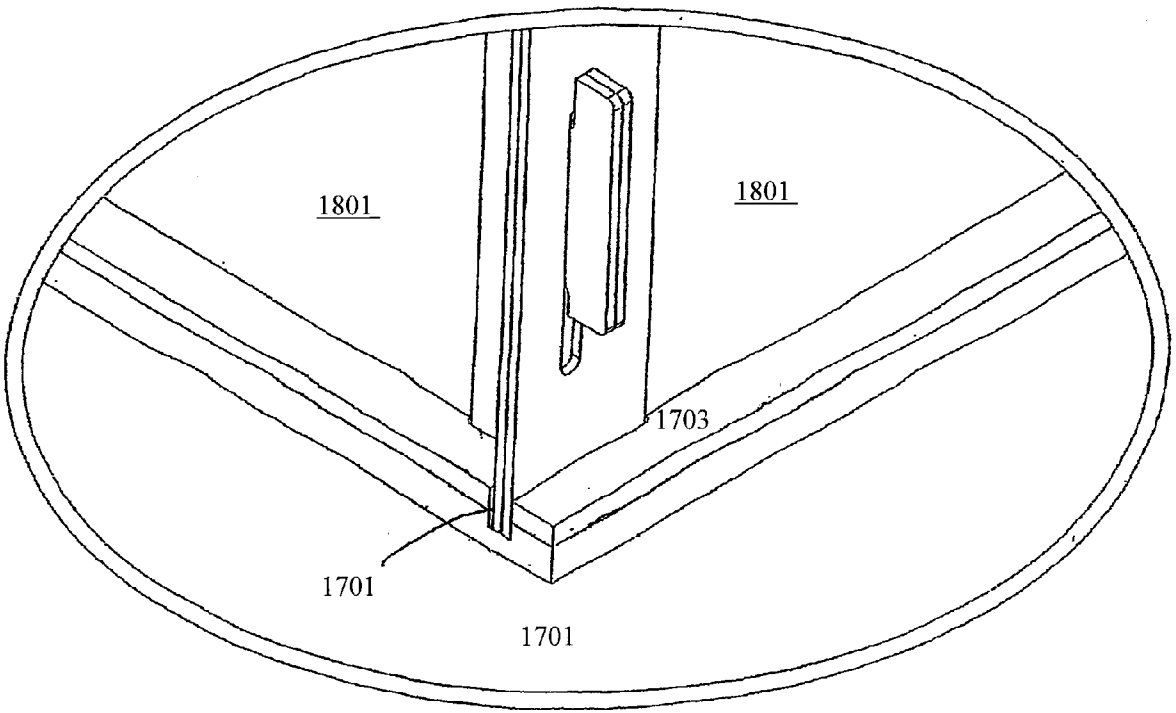
FIG. 19 illustrates an enlarged view of a portion of the case of FIG. 18.

FIG. 19 further illustrates an enlarged view of the engagement between the deck member 1703 and the wall members 1801 of the case 1800 as shown in FIG. 18.

7. Lid Member

Figure 20A:
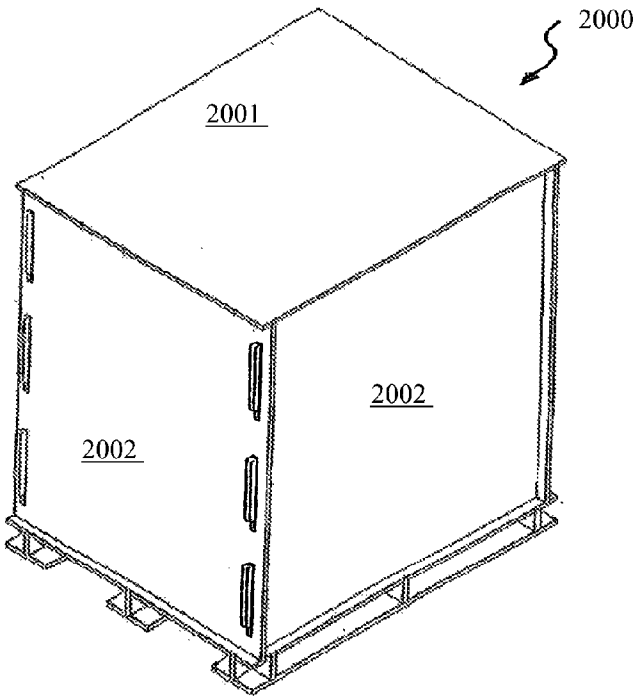
Figure 20B:
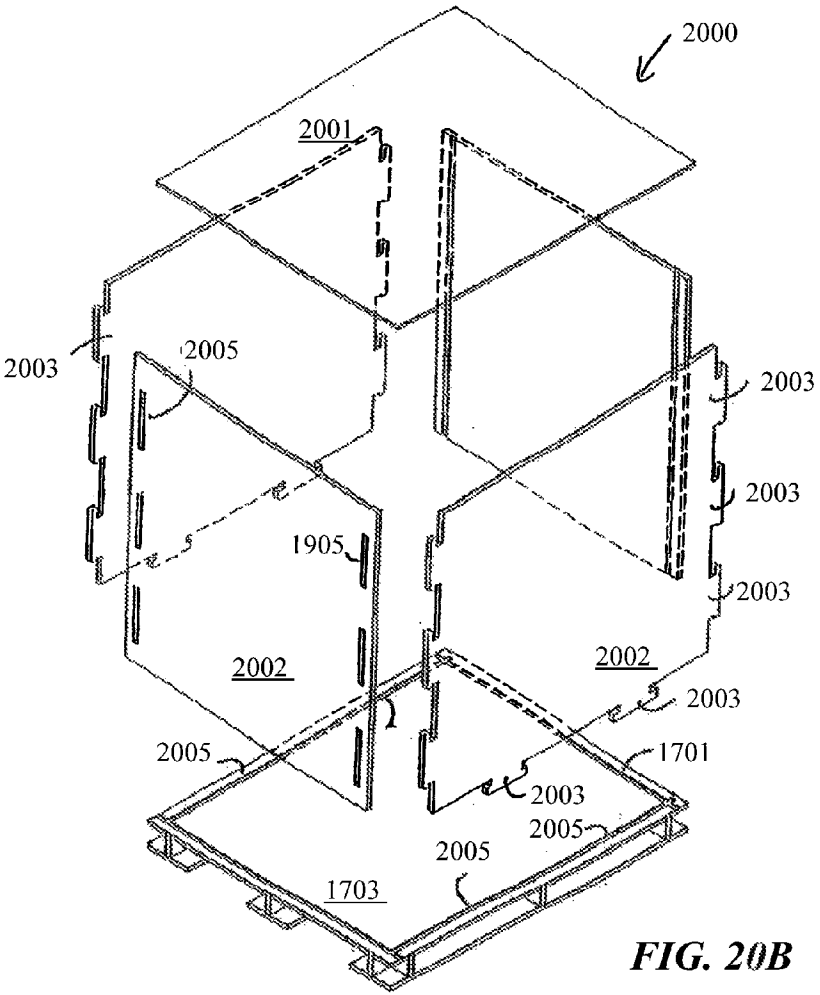
FIG. 20B illustrates an exploded view of the case of FIG. 20A.

FIGS. 20A and 20B illustrate a case 2000 having a lid member 2001 and a plurality of wall members 2002. Like the wall members 1801 of the case 1800 of FIG. 18, the wall members 2002 are also inter-engageable via an identical ear-and-slot arrangement. In contrast to the case 1800 however, each of two of the wall members 2002 further comprises two ears 2003 along the respective bottom edge which is received by the corresponding slots 2005 arranged along the recesses 1701 of the deck member 1703. In addition, whereas the wall members 1801 comprise stiffening members 1809, the wall members 2002 do not include such stiffening members.

Figure 21:
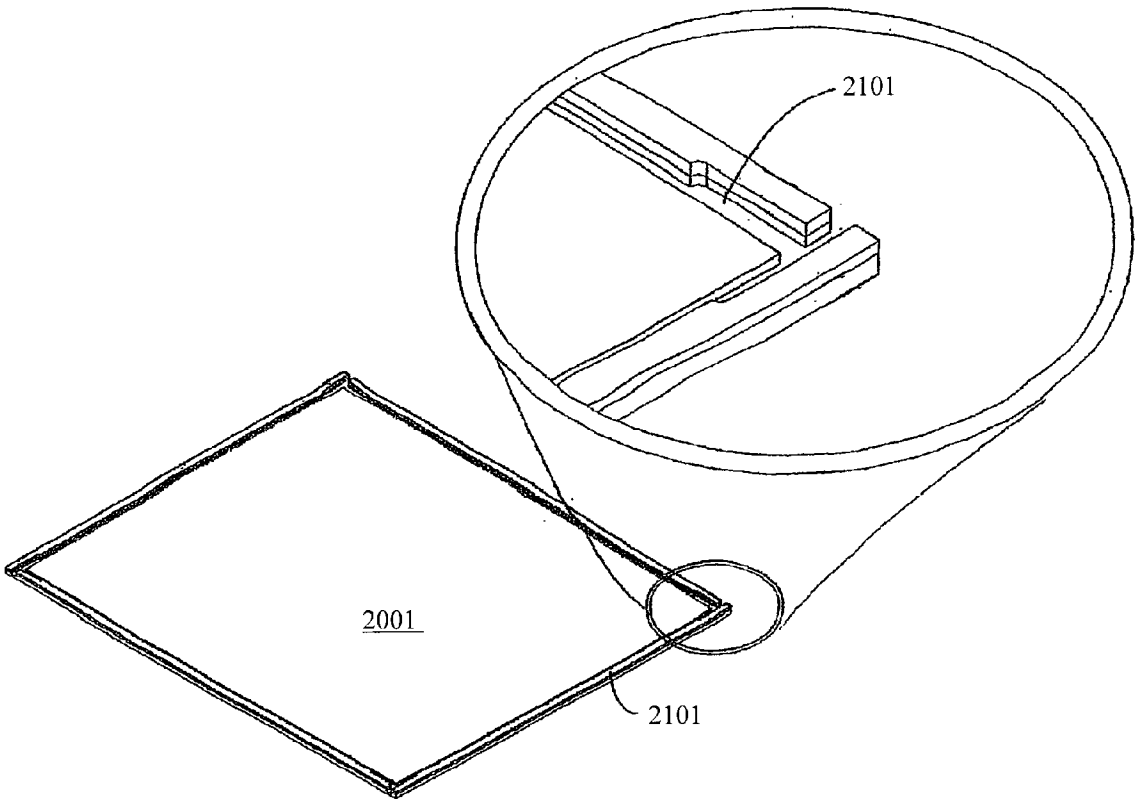
FIG. 21 illustrates an enlarged view of the underside of the lid member of FIGS. 20A and 20B.

Advantageously, the case 2000 is easily assembled and can be readily disassembled to minimise storage space. As shown in FIG. 19, the case 1800 is provided with a full seal along the edges of the deck member 1703. Specifically, the wall members 1801 fit within recesses 1701 of the deck member 1703. Similarly, as shown in FIG. 21, the case 2000 is provided with a full seal along the edges of the lid member 2001 as the upper edges of the wall members 2002 fit within the recesses 2101 of the lid member 2001.

Thus, the cases 1800, 2000 protects the contents stored therein from the ingress of water, dirt, insects and other pests. Examples of said insects and pests including but not limited to cockroaches, moths, crickets, lizards and mice. This engineered solution to the containment of freight, as shown in these embodiments, provides both strength and serviceability for longevity and sealing against contamination of said freight.

Two further variations of the cases 1800, 2000 are shown in FIGS. 22A and 22B and FIGS. 23A and 23B.

Figure 22A:
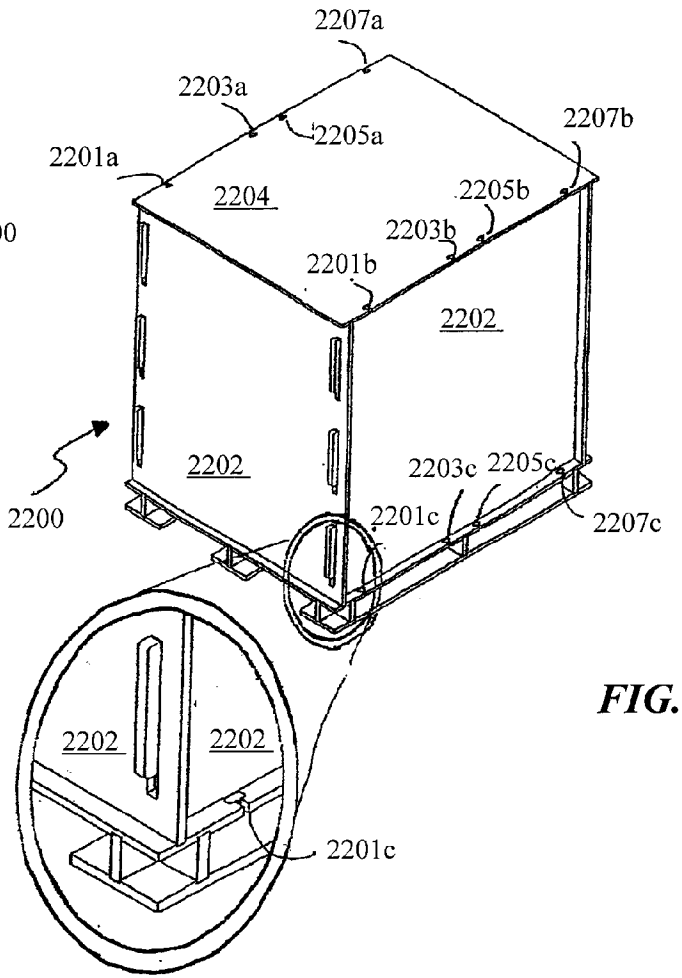
Figure 22B:
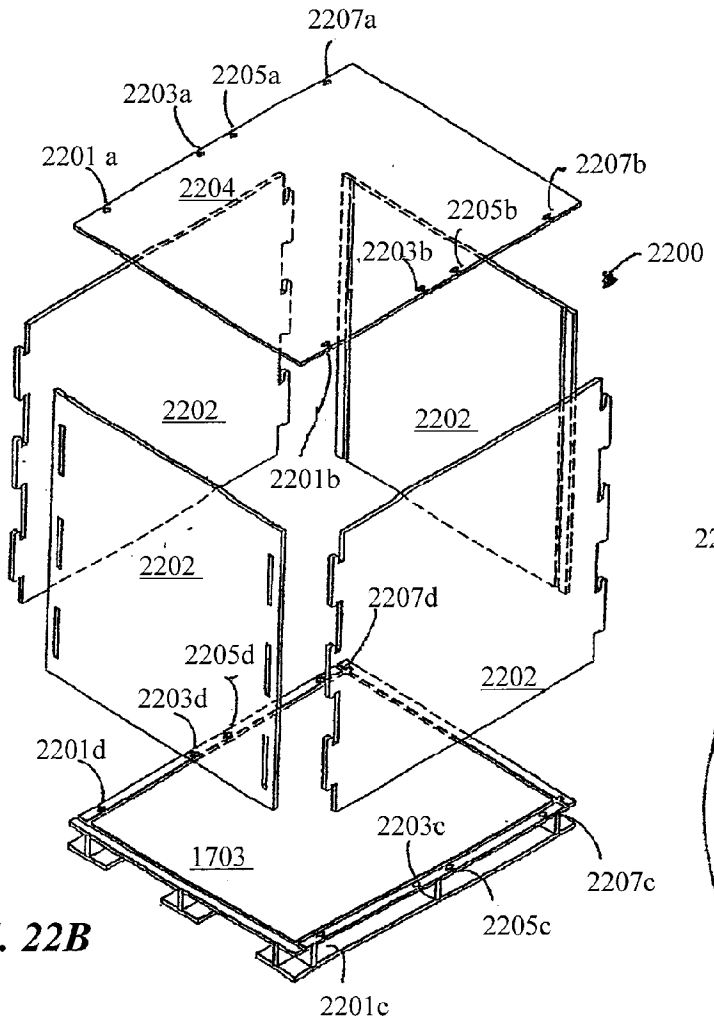
FIG. 22B illustrates an exploded view of the case of FIG. 22A.

FIGS. 22A and 22B illustrate a case 2200 comprising a lid member 2204 having a plurality of slits 2201*a,b*, 2203*a,b*, 2205*a,b* and 2207*a,b*, on two opposite edges of the lid member 2204. The deck member 1703 now includes a plurality of slits 2201*c,d*, 2203,*c,d*, 2205*c,d* and 2207*c,d* on two opposite edges. A metal wire (not shown) is used to seal around the support device 700 through the slits 2201*a,b,c,d*. Similarly, three other metal wires can also be used to seal around the case 2200 through the slits 2203*a,b,c,d*, 2205*a,b,c,d* and 2207*a,b,c,d* respectively.

Figure 23A:
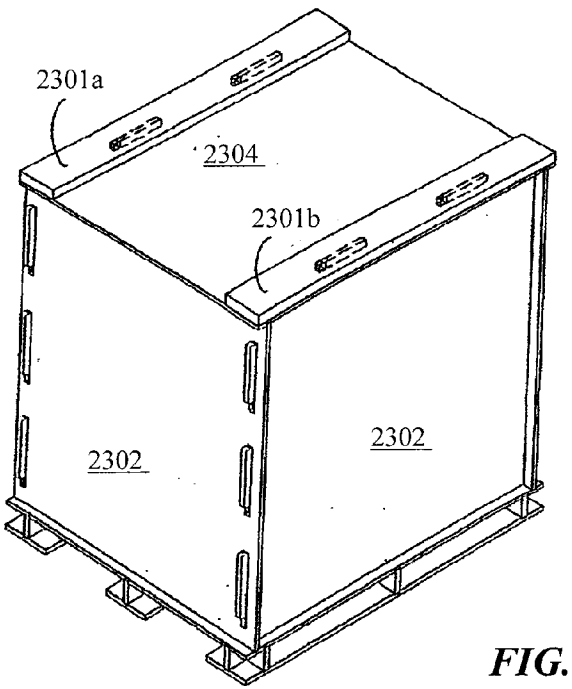
Figure 23B:
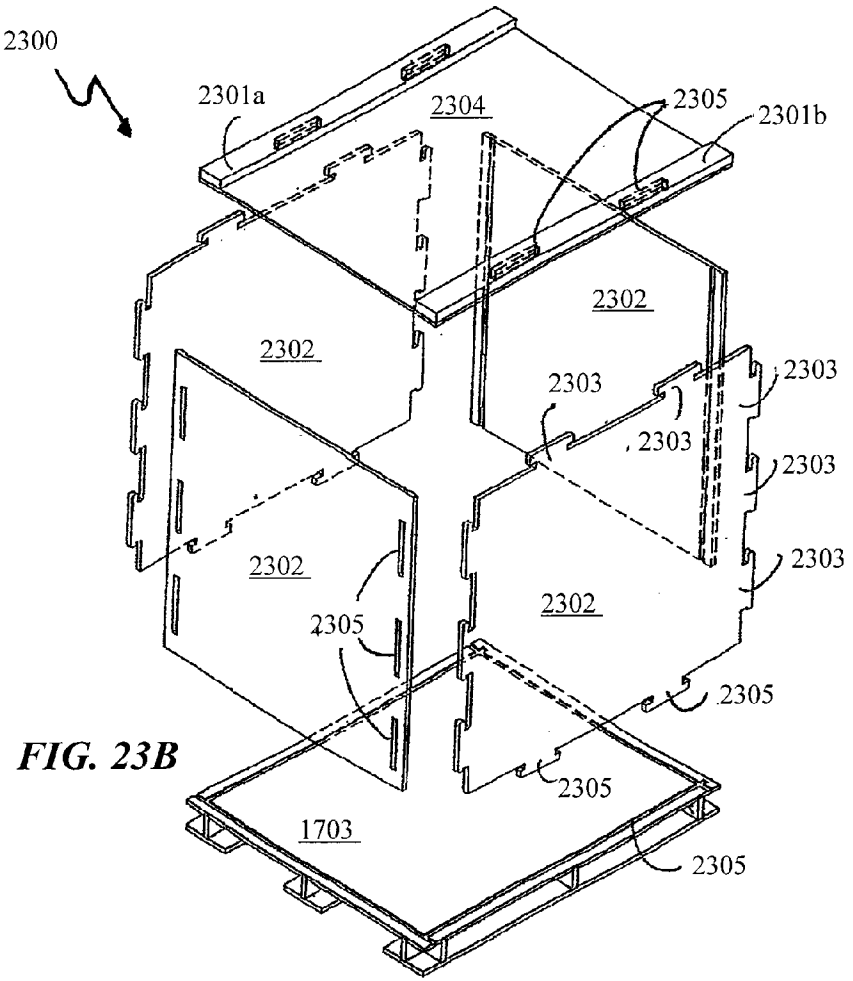
FIG. 23B illustrates an exploded view of the case of FIG. 23A.
Figures 24A, 24B, 24C, 24D:
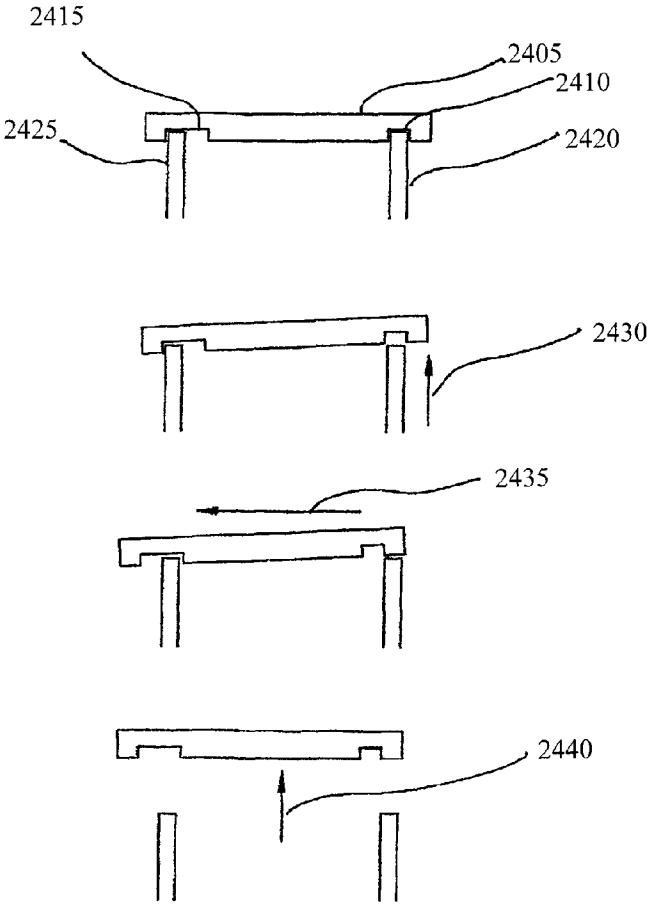
FIG. 24A to 24D illustrate sequential cross-sectional elevation views of the case according to a further embodiment showing the lead member fitting and locking to said wall members.

FIGS. 23A and 23B illustrate yet another case 2300 having a lid member 2304 and a plurality of inter-engageable wall members 2302. In particular, two of the wall members 2302 include respective ears 2303 on all edges, all of which inter-engage with corresponding slots 2305 of the respective wall members 2302, the lid member 2304 and the deck member 1703. It is seen that the respective wall members 2302, the lid member 2304 and the deck member 1703 inter-engage via an identical or similar ear-and-slot arrangement as the inter-engagement between the wall members 1801 as shown in FIG. 18.

Further, the lid member 2304 includes two stiffening members 2301*a,b* on two opposite edges so as to strengthen the engagements between the lid member 2304 and the wall members 2302.

It will be appreciated that the recesses of the lid member, the deck members and the wall members may be formed using a number of different methods. For instance, the recesses may be formed by routing the surface of the member, so as to remove material from said member. Alternatively, the recess may be formed by building up adjacent sides of the proposed recess to form a valley between two added members. In another alternative, a member may be added to the base member, be it the lid, base etc., and then the added member routed. In this way, the thickness of material beneath the recess is at least that of the base member, in addition to any remaining material not routed from the added member.

The description of the embodiments of the present invention have been presented for purposes of illustration and description, but are not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiments disclosed, but covers modifications within the scope of the present invention as defined by the appended claims.

As shown in FIGS. 24A to 24D, a further embodiment has the recesses in the lead member of differing width. The width of the first recess 2415 provides sufficient space for the lid member 2405 to slide whilst the corresponding portion of wall member 2425 is engaged with the recess 2415. The second recess 2410, being of a higher tolerance fit with the corresponding portion of the wall member 2420, will fit snugly within the wall member 2420 and so provide a lock of the lid member 2405. Only by lifting 2430 the lid member 2405 adjacent to the narrow recess 2410, can the lid be disengaged from the wall members. On disengagement, the lid member can then be slid 2435 in the horizontal plane to disengage the first recess 2415. Finally, the lid can then be lifted off 2440, so as to be free from the wall members 2420, 2425. Accordingly, the interaction of the lid with the wall members through the engagement with the recesses provides a mechanical lock to further prevent accidental removal of the lid member.

Unless the context clearly requires otherwise, throughout the description and the claims, the words "comprise", "comprising" and the like are to be construed in an inclusive as opposed to an exclusive or exhaustive sense; that is to say, in the sense of "including, but not limited to".

The invention claimed is:

1. A case comprising a support device and a plurality of wall members, the support device having:

a plurality of leg members; and a deck member mounted on the plurality of leg members; wherein the deck member comprises a plurality of recesses on a first side shaped to receive the plurality of leg members; the deck member further comprises a plurality of recesses on a second side; and the plurality of recesses on the second side are shaped to receive said plurality of wall members so as to define a storage space.

2. The case of claim 1, wherein the support device further comprises a plurality of first skirting members disposed against the first side of the deck member and along a perimeter of the deck member.

3. The case of claim 1, wherein the support device further comprises at least a second skirting member disposed between two adjacent leg members of the plurality of leg members.

4. The case of claim 1, wherein the support device further comprises at least one reinforcing element disposed at a corner of the deck member.

5. The case of claim 1, wherein the support device further comprises at least one stiffening element disposed against one of the plurality of leg members.

6. The case of claim 1, wherein the bridge assembly includes first and second sets of deck boards, the deck boards in each of the first and second sets being in a spaced apart relationship, wherein the first set of deck boards is substantially orthogonal to the second set of deck boards.

7. The case of claim 6, wherein the first and second sets of deck boards are mounted in a spaced apart relationship from the first side of the deck member via a plurality of bridge support members.

8. The case of claim 1, wherein the support device further comprising at least one skid member engaged with at least one of the plurality of leg members, the at least one skid member for enhancing stability of the support device.

9. The case of claim 8, wherein the at least one skid member comprises a plurality of recesses shaped to engage with the at least one of the plurality of leg members.

10. The case of claim 1, wherein the wall members are inter-engageable through cooperative engagement portions located at adjacent extreme ends of the plurality of wall members.

11. The case of claim 10, wherein the cooperative engagement portions comprise corresponding projections and apertures shaped to selectively engage and disengage from each other.

12. The case of claim 11, wherein each projection includes at least one lug directed at right angles to an axis of insertion of the projection into the corresponding aperture.

13. The case of claim 10, wherein the engagement portions further include a longitudinal recess into which an edge of an adjacent wall member is mounted.

14. The case of claim 1, further comprising a lid being engaged with the plurality of wall members.

15. The case of claim 14, wherein the lid comprises a plurality of recesses to engage with the plurality of wall members.

16. The case of claim 14, wherein the lid comprises an aperture through which a corresponding lug of one of the plurality of wall members is directed so that the lid engages with that wall member.

17. The case of claim 14, wherein the lid and the deck member comprise a plurality of slits for accommodating a wire around the support device.

18. The case of claim 1, wherein said support device includes any one of: a pallet, a tray and a rack.

19. The case of claim 1, wherein the support device is substantially made of any one or a combination of oriented strand board (OSB), high density polyethylene (HDPE), sawn timber, particle board and recycled plastic.

* * * * *